US007873300B2

(12) United States Patent
Fuwa et al.

(10) Patent No.: US 7,873,300 B2
(45) Date of Patent: Jan. 18, 2011

(54) SINGLE COMPONENT DEVELOPMENT DEVICE, PROCESS CARTRIDGE AND TONER

(75) Inventors: Kazuoki Fuwa, Kawanishi (JP); Masayuki Hagi, Minoo (JP); Yoshihiro Mikuriya, Nishinomiya (JP); Hideaki Yasunaga, Ibaragi (JP); Hiroaki Katoh, Nagaokakyo (JP); Yoshitaka Sekiguchi, Nishinomiya (JP); Satoshi Ogawa, Nara (JP)

(73) Assignee: Ricoh Company Limited, Tokyo (JP)

( * ) Notice: Subject to any disclaimer, the term of this patent is extended or adjusted under 35 U.S.C. 154(b) by 78 days.

(21) Appl. No.: 12/186,102

(22) Filed: Aug. 5, 2008

(65) Prior Publication Data

US 2009/0041511 A1 Feb. 12, 2009

(30) Foreign Application Priority Data

Aug. 6, 2007 (JP) ..... 2007-203813

(51) Int. Cl.
*G03G 15/08* (2006.01)

(52) U.S. Cl. ..... 399/111; 399/116; 399/119; 399/258; 399/262; 399/263; 399/264; 399/274

(58) Field of Classification Search ..... 399/111, 399/116, 119, 258, 262, 263, 264, 274
See application file for complete search history.

(56) References Cited

U.S. PATENT DOCUMENTS

| | | | | |
|---|---|---|---|---|
| 6,334,038 | B1 | 12/2001 | Kawahara | |
| 2002/0004176 | A1* | 1/2002 | Tanabe et al. | 430/137.14 |
| 2003/0152856 | A1* | 8/2003 | Mizoe et al. | 430/108.1 |
| 2005/0058928 | A1 | 3/2005 | Toyama et al. | |
| 2006/0040198 | A1* | 2/2006 | Yamazaki et al. | 430/124 |
| 2006/0204281 | A1* | 9/2006 | Wada et al. | 399/227 |
| 2007/0026335 | A1 | 2/2007 | Yamamoto et al. | |
| 2007/0148568 | A1 | 6/2007 | Kadota et al. | |
| 2007/0207399 | A1 | 9/2007 | Kadota et al. | |
| 2007/0297822 | A1* | 12/2007 | Yoshida et al. | 399/59 |
| 2007/0298338 | A1* | 12/2007 | Nakamura et al. | 430/48 |

FOREIGN PATENT DOCUMENTS

| | | |
|---|---|---|
| JP | 5-35073 | 2/1993 |
| JP | 6-102705 | 4/1994 |
| JP | 9-90738 | 4/1997 |

OTHER PUBLICATIONS

U.S. Appl. No. 12/027,704, filed Feb. 7, 2008, Kazuoki Fuwa et al.

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A single component development device including a toner including a resin, a coloring agent, a wax, a charge control agent and an inorganic particulate, a development roller to bear the toner on the surface of the development roller and transfer the toner to an image bearing member and a thin layer forming member to regulate a thickness of the layer of the toner while in contact with the surface of the development roller via the toner borne thereon, wherein a regulating pressure A between the thin layer forming member and the development roller is from 25 to 60 (N/m), a content Z (weight %) of the charge control agent satisfies the following relationship (1) and an average dispersion particle diameter D (nm) of the charge control agent satisfies the following relationship (2):

$$0.029\times A-0.150>Z>0.013\times A-0.013 \quad \text{Relationship (1)}$$

$$D<6.3\times A-106.3 \quad \text{Relationship (2).}$$

10 Claims, 1 Drawing Sheet

FIGURE
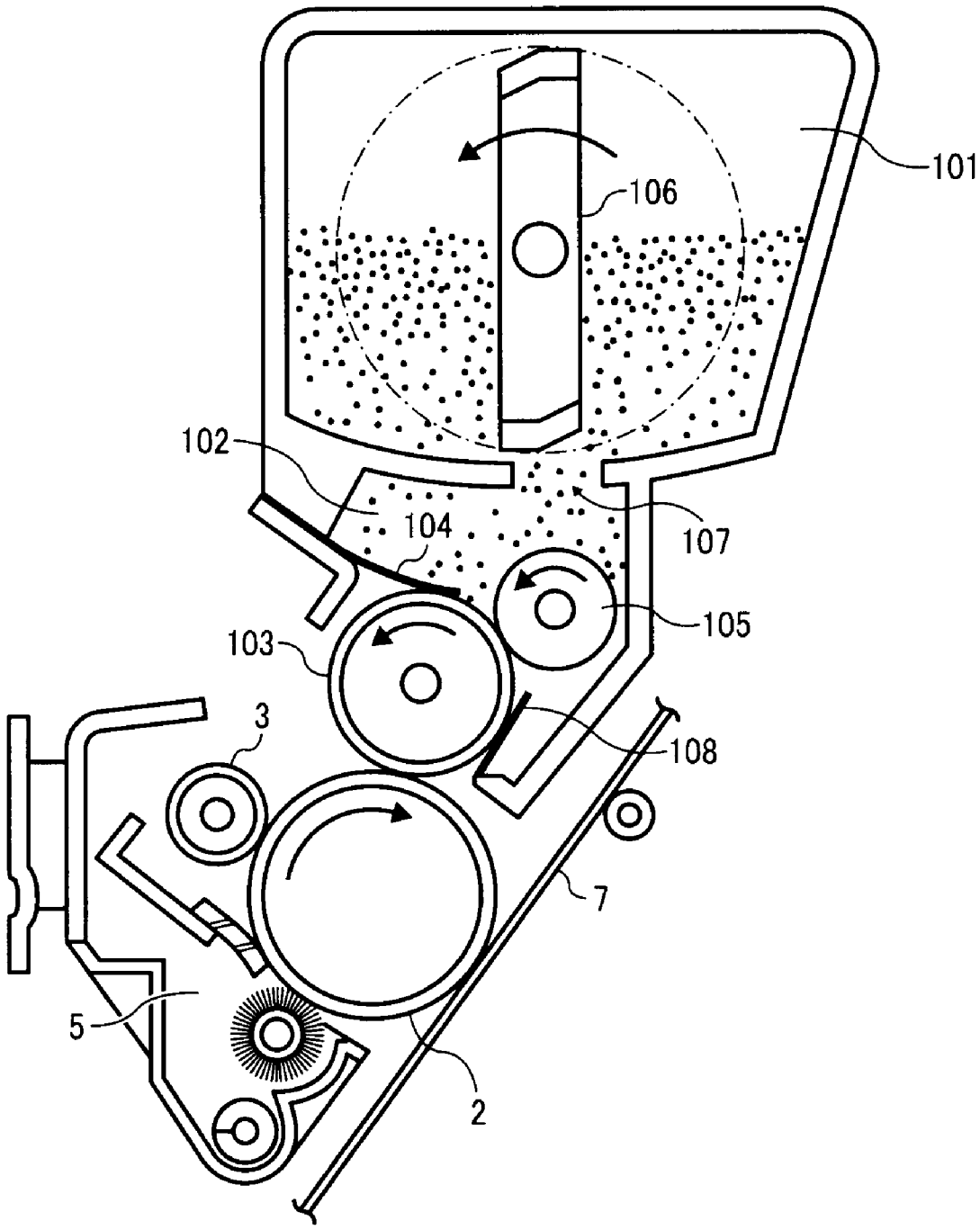

SINGLE COMPONENT DEVELOPMENT DEVICE, PROCESS CARTRIDGE AND TONER

BACKGROUND OF THE INVENTION

1. Field of the Invention

The present invention relates to a single component development device and a process cartridge using the single component development device.

2. Discussion of the Background

There are two types of dry development methods adopted in electrophotography. One is a system in which a two component developing agent including a toner and a carrier is used and the other is a system in which a single component developing agent including a toner without a carrier is used. In recent years, the method using a single component developing agent has been popular for a low end laser printer in terms of size reduction. In the case of a single component development device, there is a widely adopted system in which a thin layer forming member is provided facing a development roller to regulate the layer thickness of the toner transferred on the surface of the development roller and charge the toner by pressing the toner when the toner passes through the thin layer forming member.

However, there is a problem to this method, which is the driving torque of the development roller increases due to the friction between the layer thickness forming member and the development roller. In addition, when the regulation pressure to the toner is set from about 25 to about 60 (N/m) to relieve the friction between the thin layer forming member and the development roller, the toner attached to the nipping portion of the thin layer forming member where the toner is nipped by the thin layer forming member and the development roller tends to be hardly transferred, which leads to a fixation problem.

Taking into account such a background, there is a technology which describes a non-magnetic single component development device that suitably maintains the charging property and the fluidity property of toner without deterioration even when the attachment state of external additives of the single component developing agent (i.e., toner) varies due to the load by a layer thickness regulating member (thin layer forming member), thereby stably producing quality images. This toner includes a particular charge control agent {(bis-[3,5-di (t-butyl)salicylate]boron (III) potassium)} to prevent deterioration of the charging property and the fluidity property caused when the toner passes through the layer thickness regulating member. However, there is no description about the regulating pressure between the layer thickness regulating member and the development roller or dispersion of a charge control agent in the non-magnetic single component development device. Thus, it is difficult to prevent fixation of toner on the development roller and reduce the driving torque of the development roller.

There is another technology which describes a development device which relieves the driving force and elongates working life of an image bearing member by setting the ten point height of irregularities (Rzjis) of the development roller in a range of from 20 to 50 μm and the gap between the development roller and the image bearing member in a range of from 150 to 400 μm. However, since this development device has a large Rzjis, the surface state of the development roller greatly changes by the friction with the thin layer forming member, which makes it difficult to maintain producing quality images for an extended period of time.

SUMMARY OF THE INVENTION

Because of these reasons, the present inventors recognize that a need exists for a single component development device which prevents fixation of toner on a development roller and relieves the driving torque of the development roller to produce quality images for an extended period of time and a process cartridge including the single component development device.

Accordingly, an object of the present invention is to provide a single component development device which prevents fixation of toner on a development roller and relieves the driving torque of the development roller to produce quality images for an extended period of time and a process cartridge including the single component development device. Briefly this object and other objects of the present invention as hereinafter described will become more readily apparent and can be attained, either individually or in combination thereof, by a single component development device including a toner including a resin, a coloring agent, a wax, a charge control agent and an inorganic particulate, a development roller to bear the toner on the surface of the development roller and transfer the toner to an image bearing member and a thin layer forming member to regulate a thickness of the layer of the toner while in contact with the surface of the development roller via the toner borne thereon, wherein the regulating pressure A between the thin layer forming member and the development roller is from 25 to 60 (N/m), the content Z (weight %) of the charge control agent satisfies the following relationship (1): $0.029\times A-0.150>Z>0.013\times A-0.013$ and the average dispersion particle diameter D (nm) of the charge control agent satisfies the following relationship (2): $D<6.3\times A-106.3$.

It is preferred, in the single component development device, the toner has a volume average particle diameter of from 6 to 10 μm.

It is still further preferred that, in the single component development device, the content of the wax in the toner is from 2.0 to 4.0% by weight.

It is still further preferred that, in the single component development device, the maximum endothermic peak in the temperature range of from 30 to 200° C. in the endothermic curve obtained by a differential scanning calorimeter (DSC) of the toner is 65 to 95° C.

It is still further preferred that, in the single component development device, the content of the inorganic particulate is from 2.0 to 4.5% by weight.

It is still further preferred that, in the single component development device, the toner has a softening point of from 120 to 140° C.

It is still further preferred that, in the single component development device, the charge control agent is of a discharging type comprising a boron.

As another aspect of the present invention, a process cartridge is provided which includes the single component development device mentioned above.

As another aspect of the present invention, a method of forming images is provided which includes forming visualized images by using the single component development device mentioned above or the process cartridge mentioned above.

As another aspect of the present invention, a toner for use in a single component development device is provided which includes a resin, a coloring agent, a wax, a charge control agent and an inorganic particulate. The single component development device includes a development roller to bear the toner on the surface of the development roller and transfer the toner to an image bearing member, and a thin layer forming member to regulate a thickness of a layer of the toner while in contact with the surface of the development roller via the toner borne thereon. The regulating pressure A between the thin layer forming member and the development roller is from 25 to 60 (N/m), and the content Z (weight %) of the charge control agent satisfies the following relationship (1): $0.029\times A-0.150>Z>0.013\times A-0.013$ and the average dispersion particle diameter D (nm) of the charge control agent satisfies the following relationship (2): $D<6.3\times A-106.3$.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic diagram illustrating a single component development device.

DETAILED DESCRIPTION OF THE INVENTION

The present invention will be described below in detail with reference to several embodiments and the accompanying drawing.

FIG. 1 is a cross section illustrating an example of the main part of the single component development device related to the present invention. The single component development device includes a toner container 101, a toner supplying room 102 provided below the toner container 101, a development roller 103, a thin layer forming member (layer thickness regulating member) 104 provided in contact with the development roller 103 via the toner on the development roller 103 and a supplying roller 105. The development roller 103 is arranged in contact with a photoreceptor drum 2 functioning as a typical image bearing member and a development bias is applied to the development roller 103 from a high voltage power supply (not shown). A toner stirring member 106 is provided in the toner container 101 and rotates counterclockwise. The toner stirring member 106 has a large toner transfer area driven by rotation at the portion where the front end of the toner stirring member 106 does not pass near an opening 107 in the axial direction. Therefore, the toner accommodated in the toner container 101 is sufficiently stirred and fluidized. The toner transfer area driven by rotation is reduced at the portion where the front end of the toner stirring member 106 passes near the opening 107. Due to this structure, an excessive amount of toner is prevented from guiding to the opening 107. Toner around the opening 107 is suitably loosened by the toner stirring member 106, passes through the opening 107 by its own weight and falls into the toner supplying room 102. Foam material having cells (holes) is coated on the surface of the supplying roller 105. Thus, the foam material efficiently attaches the toner transferred to the toner supplying room 102 and prevents toner deterioration caused by the concentration of pressure at the contact portion with the development roller 103. It is preferred that the foam material has an electric resistance of from $1.0\times10^3$ to less than $1.0\times10^{15}$. A supplying bias having an offset value having the same direction as that of the charging polarity of the toner against the development bias is applied to the supplying roller 105. This supplying bias works in the direction in which the toner preliminarily charged at the contact portion with the development roller 103 is pressed against the development roller 103. The offset direction is not limited to this. The offset can be set to 0 or in a different direction depending on the kind of toner. The supplying roller 105 rotates counterclockwise and supplies the toner attached to the surface thereof to the surface of the development roller 103. A roller covered by an elastic rubber layer is used as the development roller 103. There is provided a surface coating layer formed of a material which is easily charged with a polarity reversed to that of the toner. The elastic rubber layer is set to have a hardness of not greater than 50 according to JIS-A to maintain the contact state with the photoreceptor drum 2 to be uniform and an electric resistance of $1.0\times10^3$ to less than $1.0\times10^{11}$ to work the development bias. The surface roughness Ra is set to be from 0.2 to 2.0 μm and a suitable amount of toner is held on the surface. The development roller 103 rotates counterclockwise and transfers the toner held on the surface to the portion facing the layer thickness regulating member 104 and the photoreceptor drum 2. The layer thickness regulating member 104 has a free end which is brought into contact with the surface of the development roller 103 with a pressure of from 10 to 100 N/m by using a metal plate spring made of SUS304CSP, SUS301CSP or phosphor bronze. The layer thickness regulating member reduces the layer thickness of the toner and abrasively charges the toner when the toner passes through the layer thickness regulating member under this pressure. To assist the friction charging, a regulating bias having a value offset to the development bias in the same direction as that of the polarity of the toner is applied to the layer thickness regulating member 104. The photoreceptor drum 2 rotates clockwise and thus the surface of the development roller 103 moves in the same direction as that of the photoreceptor drum 2 at the facing position thereof. The toner forming a thin layer is transferred to the position facing the photoreceptor drum 2 by the rotation of the development roller 103. Then, the toner moves to the surface of the photoreceptor drum 2 due to the development bias applied to the development roller 103 and the latent electrostatic image electric field formed by a latent electrostatic image on the photoreceptor drum 2 and develops the latent electrostatic image. A sealing seal 108 is provided in contact with the development roller 103 at the place where the toner remaining on the photoreceptor drum 2 without being used for development is returned to the toner supplying room 102. Thus, the toner is prevented from scattering outside the single component development device. In FIGURE, 3 represents a contact type charging roller, 5 represents a remaining toner removing member and 7 represents a casing.

Since a particular toner is used in the present invention, it is possible to set the regulating pressure between the thin layer forming member and the development roller to be from 25 to 60 (N/m). When the regulating pressure is too small, the amount of toner passing through the thin layer forming member tends to increase so that the line image broadens and thus a sharp and clear image is not obtained. By contrast, when the regulating pressure is too great, the amount of toner passing through the thin layer forming member tends to decrease so that the that the line image is thin and thus a sharp and clear image is not obtained.

The toner for use in the present invention includes inorganic particulates externally added to a mother toner particle as an external additive. The mother toner particle typically includes a resin (binder resin), a coloring agent, a charge control agent, a releasing agent (wax) and other additives. The mother toner particle is obtained by melting and mixing a coloring agent, a charge control agent, a releasing agent (wax), etc. in a thermoplastic resin as a binder resin to prepare a composition in which the coloring agent, the charge control agent, the releasing agent (wax), etc. are uniformly dispersed in the thermoplastic resin as a binder resin followed by pulverization and classification.

Binder Resin

In the present invention, there is no specific limit to the selection of the binder resin for use in the toner. Known binder resins in the full color toner field can be used. Specific examples thereof include, but are not limited to, polyester resins, (meth)acryl resins, styrene-(meth)acryl copolymer resins, epoxy resins, COC (cyclic olefin resin) such as TOPAS-COC, manufactured by Daicel Chemical Industries, Ltd. In terms of anti-stress in a single component development device, it is preferred to use a polyester resin.

Preferred examples of the polyester resins are, for example, polyester resins obtained by polycondensation of a polyalcohol and a polycarboxylic acid.

Specific examples of the polyalcohols include, but are not limited to, an adduct of bisphenol A alkylene oxide such as polyoxypropylene (2,2)-2,2-bis(4-hydroxyphenyl)propane, polyoxypropylene (3,3)-2,2-bis(4-hydroxyphenyl)propane, polyoxypropylene (6)-2,2-bis(4-hydroxyphenyl)propane, and polyoxyethylene(2,0)-2,2-bis(4-hydroxyphenyl)propane, ethylene glycol, diethylene glycol, triethylene glycol, 1,2-propylene glycol, 1,3-propylene glycol, 1,4-butan diol, neopentyl glycol, 1,4-butane diol, 1,5-pentane diol, 1,6-hexane diol, 1,4-cyclohexane dimethanol, dipropylene glycol, polyethylene glycol, polytetra methylene glycol, bisphenol A, and hydrogen added bisphenol A.

Specific examples of tri- or higher alcohols include, but are not limited to, sorbitol, 1,2,3,6-hexane tetrol, 1,4-sorbitan, pentaerythritol, dipentaerythritol, tripentaerythritol, 1,2,4-betane triol, 1,2,5-pentane triol, glycerol, 2-methyl propane triol, 2-methyl propane triol, 2-methyl-1,2,4-butane triol, trimethylol ethane, trimethylol propane, and 1,3,5-trihydroxyl methyl benzene.

Among the polycarboxylic acids, specific examples of dicarboxylic acids include, but are not limited to, maleic acid, fumaric acid, cytraconic acid, itaconic acid, glutaconic acid, phthalic acid, isophthalic acid, terephthalic acid, cyclohexane dicarboxylic acid, succinic acid, adipic acid, sepatic acid, azelaic acid, malonic acid, n-dodecenyl succinic acid, isododecenyl succinic acid, n-dodecyl succinic acid, isododecyl succinic acid, n-octyenyl succinic acid, isooctenyl succinic acid, n-octyl succinic acid, isooctyl succicnic acid and anhydrides or lower alkyl esters thereof.

Specific examples of tri- or higher carboxylic acids include, but are not limited to, 1,2,4-benzene tricarboxylic (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylene carboxyl)methane, 1,2,7,8-octane tetra carboxylic acid, pyromellitic acid, EnPol trimer acid, and anhydrides or lower alkyl esters thereof.

In the present invention, a mixture of a material monomer of a polyester resin, a material monomer of a vinyl resin and a monomer reactive with both material monomers is used to obtain a resin (hereinafter referred to as vinyl based polyester resin) by conducting a polycondensation reaction to obtain a polyester resin and a radical polymerization reaction to obtain a vinyl resin in the same vessel. The monomer reactive with both material monomers is a monomer usable for both polycondensation reaction and radical polymerization reaction, that is, a monomer having a carboxyl group which can conduct a polycondensation reaction and a vinyl group which can conduct a radical polymerization reaction. Specific examples thereof include, but are not limited to, fumaric acid, maleic acid, acrylic acid, and metacrylic acid.

Specific examples of the material monomers of the polyester resins include, but are not limited to, the polyalcohols and polycarboxylic acids mentioned above.

Specific examples of the material monomers of the vinyl resins include, but are not limited to, styrene or derivatives thereof such as o-methyl styrene, m-methyl styrene, p-methyl styrene, α-methyl styrene, p-ethyl styrene, 2,4-dimethyl styrene, p-tert-butyl styrene, and p-chlorostyrene; ethylene based unsaturated mono-olefins such as ethylene, propylene, butylene, and isobutylene; alkyl methacrylates such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, and dodecyl methacrylate; alkyl acrylates such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic acid, methacrylic acid, itaconic acid and maleic acid; acrylonitrile, esters of maleic acid, esters of itaconic acid, vinyl chloride, vinyl acetate, vinyl benzoate, vinylmethyl ketone, vinylhexyl ketone, vinylmethyl ether, vinylethyl ether, and vinylisobutyl ether.

Specific examples of the polymerization initiators to polymerize the material monomer of vinyl based resins include, but are not limited to, azo-based or diazo-based polymerization initiators such as 2,2'-azobis(2,4-dimethyl valero nitrile, 2,2'-azobisisobutylo nitrile, 1,1'azobis(cyclohexane-1-carbonitrile), and 2,2'-azobis-4-methoxy-2,4-dimethyl valero nitrile, and peroxide-based polymerization initiators such as benzoyl peroxide, dicumyl peroxide, methylethyl ketone peroxide, isopropyl peroxy carbonate, and lauroyl peroxide.

The polyester resins mentioned above are preferably used as the binder resin. Among these, in terms of improvement on releasability and anti-offset property as the toner for oil free fixing, it is more preferred to use the following first binder resin and second binder resin in combination.

Preferred first binder resins are polyester resins obtained by polycondensation of the polyalcohol and polycarboxylic acid mentioned above. Especially, the polyester resin prepared by using an adduct of bisphenol A with alkylene oxide as the polyalcohol and terephthalic acid and fumaric acid as the polycarboxylic acid is particularly preferred.

Preferred second binder resins are vinyl based polyester resins. The vinyl based polyester resin obtained by using an adduct of bisphenol A with alkylene oxide, terephthalic acid, trimellitic acid and succinic acid as the material monomer for the polyester resin, styrene and butyl acrylate as the material monomer for the vinyl based monomer and fumaric acid as the monomer reactive with both material monomers is particularly preferred.

In the present invention, it is preferred to internally add a hydrocarbon wax when the first binder resin is synthesized. To internally add a hydrocarbon wax to the first binder resin in advance, it is suitable to synthesize the first binder resin from the state in which a hydrocarbon wax is added in a monomer used for synthesizing the first binder resin. For example, it is good to conduct polycondensation reaction from a state in which a hydrocarbon wax is added to an acid monomer or an alcohol monomer forming a polyester resin as the first binder resin. When the first binder resin is a vinyl-based polyester resin, it is suitable to conduct polycondensation reaction and radical polymerization reaction by dropping a material monomer for a vinyl resin to a mixture in which a hydrocarbon wax is added to a material monomer for the polyester resin while stirring and heating the monomer The content ratio of the first binder resin (including the content of the internally added wax) and the second binder resin in toner particles is from 20/80 to 45/55% by weight and preferably from 30/70 to 40/60% by weight. When the content ratio of the first binder resin is too small, releasability and anti-high temperature offset property tend to deteriorate. By contrast, when the content ratio of the first binder resin is too large, gloss and anti-high temperature preservability tend to deteriorate.

It is more preferable that a binder resin having the weight ratio mentioned above of the first binder resin and the second binder resin has a softening point of from 100 to 125° C. and particularly from 105 to 125° C. In the present invention, the binder resin formed of the first binder resin with internally added wax and the second binder resin has a softening point within the range mentioned above.

The first binder resin with internally added wax preferably has an acid value of from 5 to 50 mgKOH/g and more preferably from 10 to 40 mgKOH/g. The second binder resin preferably has an acid value of from 0 to 10 mgKOH/g and more preferably from 1 to 5 mgKOH/g. By using a resin having such an acid value especially when a polyester resin is used, the dispersion property of coloring agents, etc. is improved and a toner having a sufficient amount of charges can be obtained.

It is preferred that the first binder resin has a component insoluble in tetrahydrofuran (THF) in terms of anti-high temperature offset property. The content of the component insoluble in tetrahydrofuran (THF) in the first binder resin with internally added wax is preferably from 0.1 to 15% by weight, particularly from 0.2 to 10% by weight and furthermore preferably from 0.3 to 5% by weight.

Coloring Agent

As the coloring agent for use in the present invention, known pigments and dyes used as coloring agents for full color toner can be used. Specific examples thereof include, but are not limited to, carbon black, aniline black, carcoil blue, chrome yellow, ultramarine blue, Dupont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. pigment yellow 74, C.I. solvent yellow 162, C.I. pigment yellow 180, C.I. pigment yellow 185, C.I. pigment blue 15:1 and C.I. pigment blue 15:3.

The content of the coloring agent for use in a toner particle is preferably from 2 to 15 parts by weight based on 100 parts by weight of all the binder resins.

The coloring agent is preferably used as a master batch in which the coloring agent is dispersed in a mixture binder resin of the first binder resin and the second binder resin in terms of the dispersion property.

The addition amount of the master batch is suitable as long as the content of the coloring agent is in the range mentioned above. The content ratio of the coloring agent in a master batch is suitably from 20 to 40% by weight.

Wax

Wax effectively functions as a releasing agent at the interface between a fixing roller and toner particles because the wax is dispersed in the binder resin, thereby effectively improving the anti-high temperature offset property without applying a releasing agent such as oil to the fixing roller.

Specific examples of such waxes include, but are not limited to, natural waxes such as plant waxes such as carnauba wax, cotton wax, haze wax, and rice wax, animal waxes such as yellow bees wax and lanoline, mineral waxes such as ozokerite and cercine, and petroleum waxes such as paraffin, microcrystalline wax and petrolatum. In addition to these natural waxes, synthetic hydrocarbon waxes such as Fisher-Tropsch wax and polyethylene wax, and synthetic waxes such as esters, ketones, and ethers can be used. Further, fatty acid amides such as 1,2-hydroxystearic acid amide, stearic acid amides, anhydrous phthalic acid imides and chlorinated hydrocarbons, homo polymers or copolymers (e.g., copolymers of n-staryl acrylate and ethylmethacrylate) of a polyacrylate, which is a crystalline polymer resin having a relatively low molecular weight, such as poly-n-stearyl methacrylate and poly-n-lauric methacrylate, and crystalline polymers having a long chain alkyl group on its branched chain can also be used.

In general, wax having a low polarity has an excellent releasing property. Therefore, the wax for use in the present invention is preferably a hydrocarbon wax having a low polarity. A hydrocarbon wax represents a wax containing only carbon atoms and hydrogen atoms and thus an ester group, alcohol group, or an amide group is not contained therein.

Specific examples of the hydrocarbon waxes include polyolefin waxes such as polyethylene, polypropylene, copolymers of ethylene and propylene, oil waxes such as paraffin wax and microcrystalline wax, and synthesized waxes such as Fisher-Tropsch wax. Among these, polyethylene wax, paraffin wax and Fisher-Tropsch wax are preferred. Polyethylene wax and paraffin wax are more preferred.

The melting point of the wax is an endothermic peak thereof at temperature rising when measured by a differential scanning calorimeter (DSC) and is preferably from 70 to 90° C. When the melting point is too high, the wax does not sufficiently melt in the fixing process, meaning that the releasability from a fixing member is not secured. By contrast, when the melting point is too low, toner particles tend to fusion bond with each other in a high temperature and high humidity environment, which causes a problem about the preservability of the toner. The melting point of the wax is more preferably from 70 to 85° C. and furthermore preferably from 70 to 80° C.

In addition, a half value of the endothermic peak of the wax measured by a differential scanning calorimeter (DSC) at temperature rising is preferably not broader than 7° C. Since the melting point of the wax for use in the present invention is relatively low, a wax having a broad endothermic peak, meaning that the wax starts melting from a low temperature range, has an adverse impact on the preservability of toner.

The content of the wax in the toner is suitably from 2.0 to 4.0% by weight. When the content of the wax is too small, the fixing releasability tends to be insufficient. By contrast, when the content of the wax is too large, the amount of the wax attached to a thin layer forming member easily increases, resulting in occurrence of fixation.

Charge Control Agent

Known charge control agents used for use in full color toner are used for the toner of the present invention.

Specific examples thereof include, but are not limited to, Nigrosine dyes, triphenylmethane dyes, metal complex dyes including chromium, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc. Specific examples of the marketed products of the charge control agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these, a compound that controls to negatively charge toner particles is preferred.

The toner for use in the present invention preferably includes a discharging type charge control agent containing boron as the charge control agent. Such a charge control agent is effective to improve the initial charge rising.

A specific example of the discharging type charge control agent containing boron is LR-147 (manufactured by Japan Carlit Co., Ltd.).

Although, the content Z (% by weight) of the charge control agent slightly depends on the kind of binder resins, whether optional additives are used, and the method of manufacturing toner including dispersion method, the main point is that the content Z satisfies the following relationship (1): $0.029\times A-0.150>Z>0.013\times A-0.013$, where A (N/m) represents the regulating pressure between a thin layer forming member and a development roller. In addition, the average dispersion particle diameter D of the charge control agent in toner also satisfies the following relationship (2): $D<6.3\times A-106.3$.

Furthermore, when the content Z of the charge control agent in toner is greater than $0.029\times A-0.150$, the amount of charge in toner tends to be excessively great. This leads to an increase in electrostatic suction force with a development roller, resulting in deterioration of fluidity and occurrence of fixation. When the content Z of the charge control agent in toner is smaller than $0.013\times A-0.013$, the amount of charge in toner tends to be excessively low, thereby causing background fouling.

In addition, when the average dispersion particle diameter D of the charge control agent in toner is greater than $6.3\times A-106.3$ (nm), the amount of fine powder produced due to the regulating pressure tends to increase, which leads to fixation of toner to a development roller. By contrast, when the average dispersion particle diameter D of the charge control agent in toner is smaller than $6.3\times A-106.3$ (nm), the toner is prevented from fixating onto a development roller. Even when toner is finely powdered, the toner is uniformly charged so that the anti-background fouling property is improved. Also, the charge is stably and uniformly generated, which is suitable for color toner. Therefore, images are stably produced for an extended period of time even in a relatively high speed processing. Therefore, when this toner is used in an image forming apparatus (tandem arranged) which develops latent electrostatic images separately formed on latent electrostatic image bearing members corresponding to multiple colors, each of the latent electrostatic images is developed with the toner corresponding to each of the multiple colors by a development device and a multi-color development method using a development roller and a thin layer forming member (developing blade) to regulate the layer thickness of the toner supplied to the development roller followed by the sequential electrostatic transfer of the toner image to a transfer member by a transfer device in contact with the latent electrostatic image bearing members via the transfer member. Thus, it is possible to output images at a relatively high speed and stably for an extended period of time in comparison with a typical full color printer.

Although the detailed study about the reason why the effect described above is obtained by satisfying the relationship (2) has not been made, it is inferred that, as the average dispersion particle diameter D increases, the toner tends to have an interface vulnerable to cracking so that the amount of fine powder increases. The upper limit of the average dispersion particle diameter of the charge control agent is obtained by the point of origin of fixation by image evaluation.

In the present invention, the charge control agent satisfies the relationships (1) and (2) simultaneously. The toner of the present invention, which satisfies the relationships (1) and (2), does not fixate on a development roller or make the driving torque of a development roller increase. As a result, the developing process is performed smoothly.

Although the detailed study about the reason why the latent electrostatic image is excellently developed when the charge control agent satisfies the relationships (1) and (2) simultaneously has not been made, it is inferred that, the content Z of the charge control agent has an impact on the saturation amount of charge of the toner. The upper and lower limits of the content Z are obtained by varying the regulating pressure A from 25 to 60 step by step while changing the content of the charge control agent in toner. The upper limit is obtained by the point of origin of fixation by image evaluation. The lower limit is obtained by the point of origin of background fouling by image evaluation.

The volume average particle diameter of the toner of the present invention is suitably from 6 to 10 μm. When the volume average particle diameter is excessively small, the attachability of toner particles tends to extremely increase, which leads to the occurrence of fixation. By contrast, when the volume average particle diameter is excessively large, sharp and clear images are not obtained.

With regard to the present invention, in the endothermic curve obtained by the measurement of differential scanning calorimeter (DSC), the temperature indicating the maximum endothermic peak in the range of from 30 to 200° C. is preferably from 65 to 95° C. When the temperature indicating the maximum endothermic peak is too low, the wax easily exudes, which causes fixation. By contrast, when the temperature is too high, sufficient releasability is not easily obtained during fixing.

In the toner of the present invention, mother toner particles include inorganic particulates to improve the charging property of the toner. There is no specific limit to the kind of the inorganic particulates. Specific examples thereof include, but are not limited to, metal oxides such as silica, diatom earth, alumina, zinc oxide, titania, zirconia, calcium oxide, magnesium oxide, iron oxide, copper oxide, tin oxide, chromium oxide, antimony oxide, yttrium oxide, cerium oxide, samarium oxide, lantern oxide, tantalum oxide, terbium oxide, europium oxide, neodymium oxide, and ferrite, metal hydroxides such as calcium hydroxide, magnesium hydroxide, and aluminum hydroxide, and metal carbonates such as basic magnesium carbonate, calcium carbonate heavy, calcium carbonate light, zinc carbonate, barium carbonate, dawsonite, and hydrotalcite, metal hydro sulfates such as calcium sulfate, barium sulfate, and calcium sulfate fiber, metal silicates such as calcium silicate (wollastonite and xonotlite), china clay, clay, talc, mica, montmorillonite, bentonite, clay activated, sepiolite, imogolite, sericite, glass fiber, glass beads, and glass flake, metal nitrides such as aluminum nitride, boron nitride and silicon nitride, metal titanates such as potassium titanate, calcium titanate, magnesium titanate, and barium titanate, metal borates such as zinc borate and aluminum borate, metal phosphates such as tri-calcium phosphate, metal sulfides such as molybdenum sulfide, metal carbides such as silicon carbide, and carbons such as carbon black, graphite, and carbon fiber. Among these, silica, alumina and titania are particularly preferred.

These inorganic particulates suitably have a size of 5 to 100 nm and the content thereof is from 2.0 to 4.5% by weight based on the total amount of toner. When the content is too small, toner particles tend to attach to each other, causing fixation. When the content is too large, the amount of inorganic particulates detaching from toner particles increases, which causes noise on an image.

The toner of the present invention may use inorganic particulates as external additives to assist improving fluidity and developability of the toner. Specific examples of the inorganic particulates as external additives include, but are not limited to, silica, zinc oxide, tin oxide, quartz sand, titanium oxide, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide and silicon nitride.

The inorganic particulate as an external additive suitably has a size of from 5 to 100 nm and is preferably added to toner in an amount of from 2.0 to 4.5% by weight based on the total amount of the toner.

The total amount of the inorganic particulates contained in mother toner particles and the inorganic materials added thereto as an external additive is suitably from 2.0 to 4.5% by weight and preferably from 2.5 to 4.0% by weight based on the total amount of the toner.

The softening point of the toner of the present invention is preferably from 120 to 140° C. By using a toner having a softening point in this range, it is possible to have a good combination of the fixing releasability and gloss for the toner.

The softening point is measured using a flow tester (CFT-500, manufactured by Shimadzu Corporation) to weigh 1.5 g of a sample, and measure the sample under the conditions of a temperature rising speed of 3.0° C./min, a preliminarily heated time of 180 seconds, a load of 30 kg, and a measuring temperature range of from 80 to 140° C. using a die with H of 1.0 mm×Φ1.0 mm. The softening point is determined as the temperature when a half of the sample has flown out.

The process cartridge of the present invention includes the single component development device described above.

In addition, the single component development device described above or the process cartridge is used in the image formation method of the present invention.

The toner of the present invention is a single component toner suitably used in a singe component development device having a regulating pressure A between the thin layer forming member and the development roller of from 25 to 60 (N/m). This toner at least includes a resin, wax, a coloring agent, a charge control agent and an inorganic particulate and is designed and manufactured to satisfy the relationships (1) and (2).

To manufacture a toner satisfying the relationships (1) and (2) is manufactured, the content Z of the charge control agent regulated according to the regulating pressure A is calculated and the charge control agent is finely pulverized by a pulverizer beforehand to obtain a desired average dispersion particle diameter of the charge control agent.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The present invention is specifically described using Examples but is not limited thereto.

Average Dispersion Particle Diameter of Charge Control Agent

Weigh 1.0 g of toner; add 5 ml of ethanol thereto; stir the solution by a roll mill at 120 rpm for one minute; suction-filtrate the resultant; observe the trace of the charge control agent on the surface of 10 toner particles selected at random with an SEM; and calculate the average dispersion particle diameter.

Toner Particle Diameter

The method of measuring the particle size distribution of toner particles is described. Coulter Counter TA-II or Coulter Multisizer II (both are manufactured by Beckman Coulter Co., Ltd.) can be used as the measuring device for toner particle diameter and particle size distribution by Coulter Counter Method.

Toner particle diameter and toner particle size distribution are measured by Coulter Counter Method as follows: Add 0.1 to 5 ml of a surface active agent, preferably a salt of an alkyl benzene sulfonate, as a dispersant to 100 to 150 ml of an electrolytic aqueous solution, which is about 1% NaCl aqueous solution prepared by using primary NaCl and pure water, for example, ISOTON-II (manufactured by Beckman Coulter, Inc.) can be used; add 2 to 20 mg of a solidified measuring sample to the electrolytic aqueous solution; conduct dispersion treatment for the electrolytic aqueous solution in which the measuring sample is dispersed for about 1 to 3 minutes by a supersonic dispersion device; measure the volume and the number of the toner particles or the toner by the measuring device mentioned above with an aperture of 100 μm; and calculate the volume distribution and the number distribution. The weight average particle diameter (Dv) and the number average particle diameter (Dp) of the toner can be obtained based on the obtained distributions.

The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

Differential Scanning Calorimeter

As the differential scanning calorimeter (DSC), DSC6200 (manufactured by Seiko Instruments Inc.) is used. The sample is heated to 200° C., cooled down to 0° C. at a temperature descending speed of 10° C./min and then measured at a temperature rising speed of 10° C./min.

Image Evaluation

Images are evaluated for fixation and background fouling using a color laser printer (IPSIO CX2500, manufactured by Ricoh Co., Ltd.) Evaluation items and criteria are described below.

Fixation: streaks are observed with naked eyes for a solid image.

G: Good (no problem)

B: Bad (problem with quality)

Background fouling: The degree of whiteness is observed with naked eyes for a solid white image.

G: Good (no problem)

B: Bad (problem with quality)

Torque

The torque of the development roller of the device illustrated in FIGURE is measured when the thin layer forming member formed of a metal plate spring material (SUS304CSP) presses the development roller with a length of 100 mm and a regulating pressure A (N/m).

Good: Lower than 0.09 (N/m)

Bad: 0.09 (N/m) or higher

Fixing Releasability

A two component developing agent prepared by mixing and stirring 5 parts of toner and 95 parts of a silicone resin coated carrier is placed in a printing machine without a fixing device remodeled based on a color laser printer (IPSIO CX 7500, manufactured by Ricoh Co., Ltd.). A solid image having a 3 mm margin on the front end along the portrait direction is printed on six transfer sheets (TYPE6200 perpendicular to machine direction, manufactured by Ricoh Co., Ltd.) such that the image is developed with toner of from 1.0 to 1.2 mg/cm$^2$ without fixing.

The fixing portion is extracted out from an IPSIO CX 2500 (manufactured by Ricoh Co., Ltd.) and remodeled to have desired belt temperature and belt linear speed. The images on the transfer sheets are fixed from the front end margin at a belt linear speed of 125 mm/sec and a fixing belt temperature of from 140 to 190° C. with an interval of 10° C. Fixing is evaluated according to the following criterion, which is the number of the transfer sheets on which the image has been successfully fixed without the transfer sheet being wound round the fixing belt or accordion-folded and stuck at the exit of the fixing device.

Good: 4 or more successfully completed transfer sheets

Bad: 3 or less successfully completed transfer sheets

Manufacturing of Toner

Preparation of First Binder Resin

The following recipe including vinyl monomers is placed in a dripping funnel (5 L):

| | |
|---|---|
| Styrene | 600 g |
| Butyl acrylate | 110 g |
| Acrylic acid | 30 g |
| Dicumyl peroxide (polymerization initiator) | 30 g |

The following recipe including polyols is placed in a flask (5 L) equipped with a thermometer, a stainless stirrer, flowing type condenser and a nitrogen introducing tube.

| | |
|---|---|
| Polyoxypropylene (2,2)-2,2-bis(4-hydroxyphenyl)propane | 1,230 g |
| Polyoxyethylene (2,2)-2,2-bis(4-hydroxyphenyl)propane | 290 g |
| Isododecenyl succinic anhydrate | 250 g |
| Terephthalic acid | 310 g |
| 1,2,4-benzene tricarboxylix anhydrate | 180 g |
| Dibutyl tin oxido (Esterification catalyst) | 7 g |

Paraffin wax (Melting point: 73.3° C., Half value width of endothermic peak at rising temperature measured by a differential scanning calorimeter: 4° C.)

4 parts based on 100 parts of the monomers

The mixture of the vinyl monomer resins and the polymerization initiator is dropped to the flask in a mantle heater at 160° C. in nitrogen atmosphere in one hour while stirring. Polyaddition reaction is aged for 2 hours while keeping the temperature at 160° C. Thereafter, the temperature is raised to 230° C. to conduct polycondensation reaction. The polymerization degree is traced using the softening point measured by a constant load extruding narrow tube rheometer and the reaction is terminated when the softening point reaches a desired softening point to obtain a resin H1. The resin softening point thereof is 130° C.

Preparation of Second Binder Resin

The following recipe including polyols is placed in a flask (5 L) equipped with a thermometer, a stainless stirrer, flowing type condenser and a nitrogen introducing tube and heated to 230° C. to conduct polycondensation reaction in a mantle heater in nitrogen atmosphere.

| | |
|---|---|
| Polyoxypropylene (2,2)-2,2-bis(4-hydroxyphenyl)propane | 2,210 g |
| Terephthalic acid | 850 g |
| 1,2,4-benzene tricarboxylic anhydrate | 120 g |
| Dibutyl tin oxide (Esterification catalyst) | 0.5 g |

The polymerization degree is traced using the softening point measured by a constant load extruding narrow tube rheometer and the reaction is terminated when the softening point reaches a desired softening point to obtain a resin L1. The resin softening point thereof is 115° C.

Manufacturing of Toner Particle 100 parts (including 3.0 parts of internally added wax) of a mixture binder resin formed of 50 parts of the first binder resin and 50 parts of the second binder resin, 1.0 part of a boron based charge control agent (LR-147), 3.5 parts of an inorganic particulate, and a master batch containing 4 parts of a coloring agent (C.I. Pigment Red 57-1) are sufficiently mixed with a HECSCHEL MIXER. The resultant is melted and kneaded at 100° C. by a two-axis extruder (PCM-30, manufactured by Ikegai Corp.). The resultant mixture is extended by a cooling press roller to a thickness of 2 mm. Subsequent to cooling down by a cooling belt (20° C.), the cooled resultant is coarsely pulverized by a feather mill. The dispersion particle diameter of the charge control agent in the toner is changed by varying the temperature, mixing time, etc. by the HENSCHEL MIXER. Thereafter, the resultant is pulverized by a mechanical pulverizer (KTM, manufactured by Kawasaki Heavy Industries, Ltd.) until the average particle diameter is from 10 to 12 μm. Furthermore, the resultant is pulverized by a jet pulverizer (IDS, manufactured by Nippon Pneumatic Mfg. Co. Ltd.) while classifying coarse powder. Thereafter, the resultant is finely classified by a rotor type classifier (Turboplex Type classifier: 100 ATP, manufactured by Hosokawa Micron Group) to obtain a colored resin particle 1 having a desired particle diameter and circularity. A desired amount (parts) of an inorganic particulate (silicon dioxide: Cab-O-Sil®TS530, manufactured by Cabot Corporation) is externally added to 100 parts of this colored resin particle 1 followed by mixing by HENSCHEL MIXER to obtain magenta toners (Toner A to Toner O) shown in Table 1. CCA in Table 1 represents charge control agent.

The toners A to H are in the scope of the present invention. Toner I does not satisfy the relationship (2). Toner J has a regulating pressure A out of the range of from 25 to 60 (N/m). Toners K & L do not satisfy the relationship (1). Toner M has a volume diameter out of the range of from 6 to 10 μm. Toners N and O include a wax in an amount out of the range of from 2.0 to 4.0% by weight.

TABLE 1

| Toner | Amount of CCA (% by weight) | Dispersion particle diameter (nm) of CCA | Regulating pressure (N/m) | Particle diameter (μm) | Amount of wax contained (% by weight) |
|---|---|---|---|---|---|
| A | 0.55 | 40 | 25 | 6 | 2.0 |
| B | 1.00 | 200 | 60 | 6 | 2.0 |
| C | 1.00 | 220 | 60 | 10 | 2.0 |
| D | 1.50 | 250 | 60 | 8.8 | 3.0 |
| E | 0.70 | 70 | 30 | 8.6 | 3.0 |
| F | 1.00 | 150 | 45 | 9.0 | 3.0 |
| G | 0.80 | 100 | 60 | 8.2 | 3.0 |
| H | 0.70 | 70 | 30 | 10 | 4.0 |
| I | 1.00 | 250 | 50 | 8.5 | 3.0 |
| J | 1.50 | 170 | 65 | 8.6 | 3.0 |
| K | 0.50 | 140 | 50 | 8.6 | 3.0 |
| L | 1.50 | 200 | 55 | 8.8 | 3.0 |
| M | 1.20 | 180 | 50 | 5.7 | 3.0 |
| N | 1.00 | 150 | 50 | 8.3 | 4.5 |
| O | 1.00 | 120 | 50 | 8.7 | 1.5 |

Evaluation

Images using Toners A to O are evaluated. Evaluation results are shown in Table 2

TABLE 2

| Toner | Fixation | Torque | Fixation Releasability | Background fouling |
|---|---|---|---|---|
| A | G | G | G | G |
| B | G | G | G | G |
| C | G | G | G | G |
| D | G | G | G | G |
| E | G | G | G | G |
| F | G | G | G | G |
| G | G | G | G | G |
| H | G | G | G | G |
| I | B | G | G | G |
| J | G | B | G | G |
| K | G | G | G | B |
| L | B | G | G | G |
| M | B | G | G | G |
| N | B | G | G | G |
| O | G | G | B | G |

This document claims priority and contains subject matter related to Japanese Patent Application No. 2007-203813, filed on Aug. 6, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A single component development device comprising:

a toner comprising a resin, a coloring agent, a wax, a charge control agent and an inorganic particulate;

a development roller which bears the toner on a surface of the development roller and transfers the toner to an image bearing member; and a thin layer forming member which regulates a thickness of a layer of the toner while in contact with the surface of the development roller via the toner borne thereon;

wherein a regulating pressure A between the thin layer forming member and the development roller is between 25 to 60 (N/m), a content Z (weight %) of the charge control agent satisfies the following relationship (1) and an average dispersion particle diameter D (nm) of the charge control agent satisfies the following relationship (2):

$$0.029\times A-0.150>Z>0.013\times A-0.013 \quad \text{Relationship (1)}$$

$$D<6.3\times A-106.3 \quad \text{Relationship (2).}$$

2. The single component development device according to claim 1, wherein the toner has a volume average particle diameter between 6 to 10 μm.

3. The single component development device according to claim 1, wherein a content of the wax in the toner is from 2.0 to 4.0% by weight.

4. The single component development device according to claim 1, wherein a maximum endothermic peak in a temperature range of from 30 to 200° C. in an endothermic curve obtained by a differential scanning calorimeter (DSC) of the toner is 65 to 95° C.

5. The single component development device according to claim 1, wherein a content of the inorganic particulate is from 2.0 to 4.5% by weight.

6. The single component development device according to claim 1, wherein the toner has a softening point of from 120 to 140° C.

7. The single component development device according to claim 1, wherein the charge control agent is of a discharging type comprising a boron.

8. A process cartridge comprising the single component development device of claim 1.

9. A method of forming images comprising:

forming visualized images by using the single component development device of claim 1.

10. A method of forming images comprising:

forming visualized images using the process cartridge of claim 8.

* * * * *